US007909438B2

(12) United States Patent
Lee et al.

(10) Patent No.: US 7,909,438 B2
(45) Date of Patent: Mar. 22, 2011

(54) PIEZO-ELECTRIC TYPE INKJET PRINTHEAD

(75) Inventors: Tae-kyung Lee, Suwon-si (KR); Sang-kwon Wee, Hwaseong-si (KR); Jae-woo Chung, Yongin-si (KR); Tae-woon Cha, Seoul (KR); Jae-chang Lee, Hwaseong-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 626 days.

(21) Appl. No.: 11/775,424

(22) Filed: Jul. 10, 2007

(65) Prior Publication Data

US 2008/0129799 A1 Jun. 5, 2008

(30) Foreign Application Priority Data

Dec. 1, 2006 (KR) ..... 10-2006-0120979

(51) Int. Cl.
*B41J 2/045* (2006.01)

(52) U.S. Cl. ..... 347/71

(58) Field of Classification Search ..... 347/71, 347/68, 72, 47, 44–45, 40
See application file for complete search history.

(56) References Cited

U.S. PATENT DOCUMENTS

2003/0184616 A1* 10/2003 Yang et al. ..... 347/47
2006/0268075 A1* 11/2006 Sugahara et al. ..... 347/68
2008/0007598 A1* 1/2008 Hong et al. ..... 347/68

* cited by examiner

*Primary Examiner* — K. Feggins
(74) *Attorney, Agent, or Firm* — Stanzione & Kim, LLP

(57) ABSTRACT

A piezoelectric type inkjet printhead includes an upper substrate including a pressure chamber to be filled with ink that is to be ejected, a reservoir to store ink that flowed in from an ink container, a restrictor connect the reservoir to one end of the pressure chamber, an intermediate substrate comprising a damper formed on a portion of the intermediate substrate, which corresponds to other end of the pressure chamber, a lower substrate comprising a nozzle to eject ink and formed in a portion of the lower substrate, which corresponds to the damper, a hydrophobic layer formed on a bottom of the lower substrate, and a piezoelectric actuator formed on the upper substrate to supply driving power to eject ink to the pressure chamber, wherein the nozzle is formed in the lower substrate at a predetermined depth from a bottom surface of the lower substrate.

24 Claims, 5 Drawing Sheets

PIEZO-ELECTRIC TYPE INKJET PRINTHEAD

CROSS-REFERENCE TO RELATED APPLICATIONS

This application claims the benefit of Korean Patent Application No. 10-2006-0120979, filed on Dec. 1, 2006, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to a piezoelectric type inkjet printhead.

2. Description of the Related Art

Generally, inkjet printheads are devices for printing a color image on a printing medium by ejecting droplets of ink onto a desired region of the printing medium. Depending on an ink ejecting method, the inkjet printheads can be classified into two types: electro-thermal transducers (bubble jet type inkjet printheads) and electro-mechanical transducers (piezoelectric type inkjet printheads). The electro-thermal transducers generate bubbles in the ink that is to be ejected by using heat, and eject the ink utilizing the expansion of the bubbles, and the electro-mechanical transducers eject ink by using pressure generated by deforming a piezoelectric material.

FIG. 1 is a cross-sectional view illustrating a normal ink ejection of a conventional piezoelectric type inkjet printhead. FIG. 2 is a cross-sectional view illustrating an abnormal ink ejection of the conventional piezoelectric type inkjet printhead illustrated in FIG. 1.

Referring to FIG. 1, a lower substrate 10 and an intermediate substrate 20 are attached to each other. A damper 21 is formed in the intermediate substrate 20 as a path through which ink flows. A nozzle 11 is formed in the lower substrate 10. The nozzle 11 includes an ink ejecting hole 12 formed on a lower portion of the lower substrate 10, and an ink leading unit 13 formed on an upper portion of the lower substrate 10. Ink is ejected through the ink ejecting hole 12. The ink leading unit 13 connects the damper 21 to the ink ejecting hole 12, and pressurizes and leads ink from the damper 21 into the ink ejecting hole 12.

A bottom surface of the lower substrate 10 is coated with a hydrophobic layer 30, so that the lower substrate 10 is hydrophobic, thereby preventing the ink injecting hole 12 from being wetted by the ejected ink, and stably ejecting an ink drop 15 from the ink injecting hole 12.

The conventional piezoelectric type inkjet printhead finishes ejecting ink, and then performs maintenance for which ink stained around the nozzle 11 is wiped using a wiper 40 that wipes the lower substrate 10 while moving in an arrow direction.

However, as illustrated in FIG. 2, when the wiper 40 wipes and contacts the hydrophobic layer 30 coated around the ink ejecting hole 12, the hydrophobic layer 30 may be removed from the lower substrate 10.

As a result, the possibility of wetting the ink ejecting hole 12 with the ink drop 15 is increased while the hydrophobic layer 30 around the ink ejecting hole 12 is gradually removed by the wiper 40, and thus, the ink drop 15 may be abnormally ejected from the ink ejecting hole 12. In this manner, since an appropriate amount ink can not be ejected on a desired location on a printing medium when the ink drop 15 is abnormally ejected as described-above, the reliability of the conventional piezoelectric type inkjet printhead may be reduced.

SUMMARY OF THE INVENTION

The present general inventive concept provides a piezoelectric type inkjet printhead including a nozzle formed so that a hydrophobic layer formed around the nozzle may be stably maintained even when maintenance is continually performed using a wiper.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a piezoelectric type inkjet printhead including an upper substrate including a pressure chamber that is formed in the upper substrate and filled with ink that is to be ejected, a reservoir to store ink that flows in from an ink container, a restrictor to connect the reservoir to one end of the pressure chamber, an intermediate substrate comprising a damper formed in the intermediate substrate on a portion of the intermediate substrate, which corresponds to other end of the pressure chamber, a lower substrate comprising a nozzle to eject ink and formed in a portion of the lower substrate, which corresponds to the damper, a hydrophobic layer formed on a bottom of the lower substrate, and a piezoelectric actuator formed on the upper substrate to supply driving power to eject ink to the pressure chamber, wherein the nozzle is formed in lower substrate at a predetermined depth from a bottom surface of the lower substrate.

The foregoing and/or other aspects and utilities of the present general inventive concept may also be achieved by providing an inkjet head usable with a piezoelectric type inkjet printhead, including a substrate having one or more surfaces to define a pressure chamber to be filled with ink, a damper to receive the ink from the pressure chamber, and a nozzle having a center axis as an ink ejecting direction to receive the ink from the damper and to eject the ink to an outside of a bottom surface of the substrate in the ink ejecting direction, an inclination portion having a surface formed between the surface of the nozzle and the bottom surface of the substrate and inclined with respect to the ink ejecting direction, and a hydrophobic layer formed on the bottom surface of the substrate and the inclination portion.

The nozzle may be spaced-apart from the bottom surface of the substrate by a distance, and the inclination portion may have a length corresponding to the distance in the ink ejecting direction.

The nozzle may have a nozzle area in a direction perpendicular to the ink ejecting direction, and the inclination portion may have an area larger than the nozzle area.

The hydrophobic layer may include an end portion formed on the inclination portion as a part of the surface of the nozzle to eject the ink.

The hydrophobic layer may include an end portion formed on the inclination portion and being parallel to the surface of the nozzle.

The hydrophobic layer may include a first portion formed on the bottom surface of the substrate and having a first thickness and a second portion formed on the inclination portion and having a second thickness.

The first thickness in a direction perpendicular to the bottom surface may be thicker than the second thickness in a direction perpendicular to the surface of the inclination portion.

The first thickness and the second thickness may be a same in the ink ejecting direction.

The nozzle may include an ink leading unit to receive the ink from the damper, and an ink ejecting hole to eject the received ink, the ink leading unit may have a cross-sectional area variable according to a distance from the bottom surface of the substrate, the ink ejecting hole may have a cross-sectional area constant along the ink ejecting direction, and the inclination portion may have a cross-sectional area variable according to a distance from the bottom surface of the substrate.

The surface of the nozzle may include a first surface to define an ink leading unit to receive the ink from the damper, and a second surface to define an ink ejecting hole to eject the received ink, and the inclination portion may include an inside circumference corresponding to the second surface of the ink ejecting hole and an outside circumference corresponding to the bottom surface of the substrate.

The inside circumference may have a first shape, and the outside circumference may have a second shape different from the first shape.

The inside circumference may have a circular shape, and the outside circumference may have a non-circular shape.

The inclination portion may include an inside circumference corresponding to the surface of the nozzle and having a first dimension, and an outside circumference corresponding to the bottom surface of the substrate and having a second dimension.

The surface of the inclination portion may be connected between the inside circumference and the outside circumference.

The surface of the inclination portion may include one of a flat surface, a curved surface, and an inclined surface.

The surface of the inclination portion may include a combination of a flat surface, a curved surface, and an inclined surface.

The surface of the inclination portion may be different from the surface of the nozzle in the ink ejecting direction.

The foregoing and/or other aspects and utilities of the present general inventive concept may also be achieved by providing an inkjet head usable with a piezoelectric type inkjet printhead, including a substrate having surfaces to define a pressure chamber to be filled with ink, a damper to receive the ink from the pressure chamber, and a nozzle disposed along an ink ejecting direction to receive the ink from the damper and eject the ink to an outside of a bottom surface of the substrate, an inclination portion disposed between the nozzle and the bottom surface of the substrate to have an angle with the ink ejecting direction, and a hydrophobic layer formed on the bottom surface of the substrate and the inclination portion.

The foregoing and/or other aspects and utilities of the present general inventive concept may be achieved by providing an inkjet head usable with a piezoelectric type inkjet printhead, including a substrate having surfaces to define a pressure chamber to be filled with ink, a damper to receive the ink from the pressure chamber, and a nozzle disposed along an ink ejecting direction to receive the ink from the damper and eject the ink to an outside of a bottom surface of the substrate, an inclination portion connected between the nozzle and the bottom surface of the substrate and having an ink ejecting area increasing in the ink ejecting direction, and a hydrophobic layer formed on the bottom surface of the substrate and the inclination portion.

The foregoing and/or other aspects and utilities of the present general inventive concept may also be achieved by providing an inkjet head usable with a piezoelectric type inkjet printhead, including a substrate having surfaces to define a pressure chamber to be filled with ink, a damper to receive the ink from the pressure chamber, and a nozzle having a first cross-sectional area constant in an ink ejecting direction to receive the ink from the damper and to eject the ink to an outside of a bottom surface of the substrate in the ink ejecting direction, an inclination portion formed between the nozzle and the bottom surface of the substrate and having a second cross-sectional area varying according to a distance from the bottom surface of the substrate, and a hydrophobic layer formed on the bottom surface of the substrate and the inclination portion.

The foregoing and/or other aspects and utilities of the present general inventive concept may also be achieved by providing an inkjet head usable with a piezoelectric type inkjet printhead, including a substrate having surfaces to define a pressure chamber to be filled with ink, a damper to receive the ink from the pressure chamber, and a nozzle having a first shape to receive the ink from the damper and eject the ink to an outside of a bottom surface of the substrate, an inclination portion having a surface formed between the nozzle and the bottom surface of the substrate and having a second shape different from the first shape of the nozzle, and a hydrophobic layer formed on the bottom surface of the substrate and the inclination portion.

BRIEF DESCRIPTION OF THE DRAWINGS

The above and other aspects and utilities of the present general inventive concept will become more apparent by describing in detail exemplary embodiments thereof with reference to the attached drawings in which.

DETAILED DESCRIPTION OF THE PREFERRED EMBODIMENTS

Figure 1:
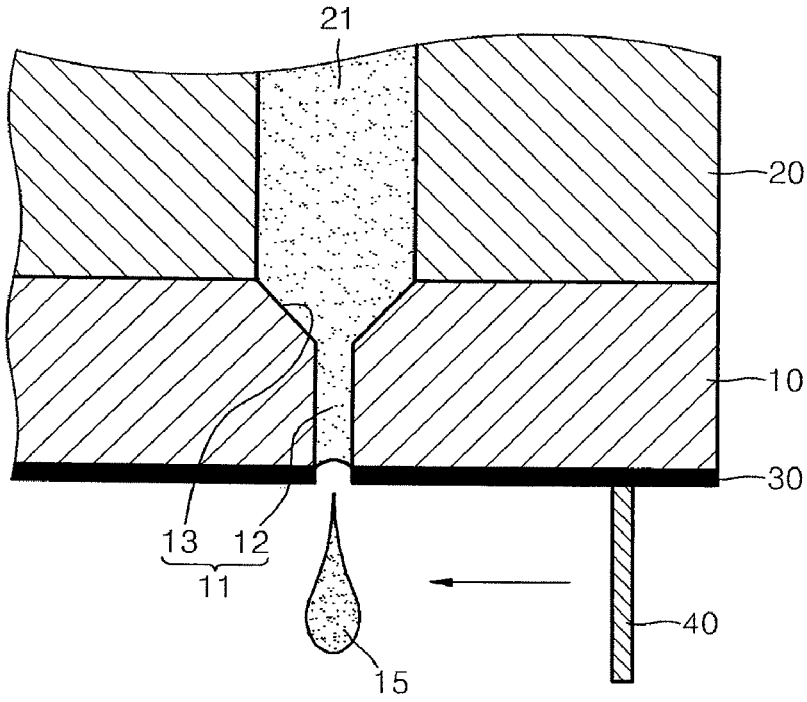
FIG. 1 is a cross-sectional view illustrating a normal ink ejection of a conventional piezoelectric type inkjet printhead.
Figure 2:
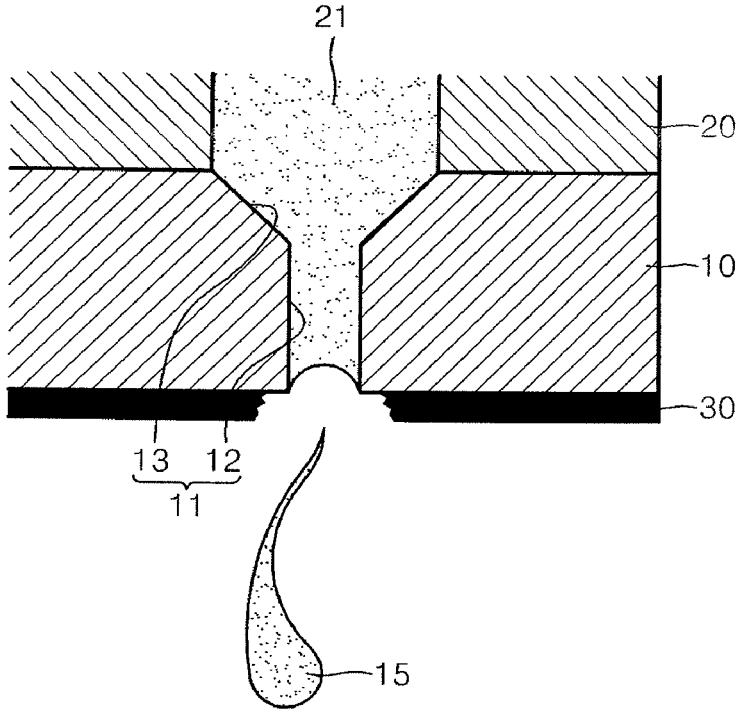
FIG. 2 is a cross-sectional view illustrating an abnormal ink ejection of the conventional piezoelectric type inkjet printhead illustrated in FIG. 1.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
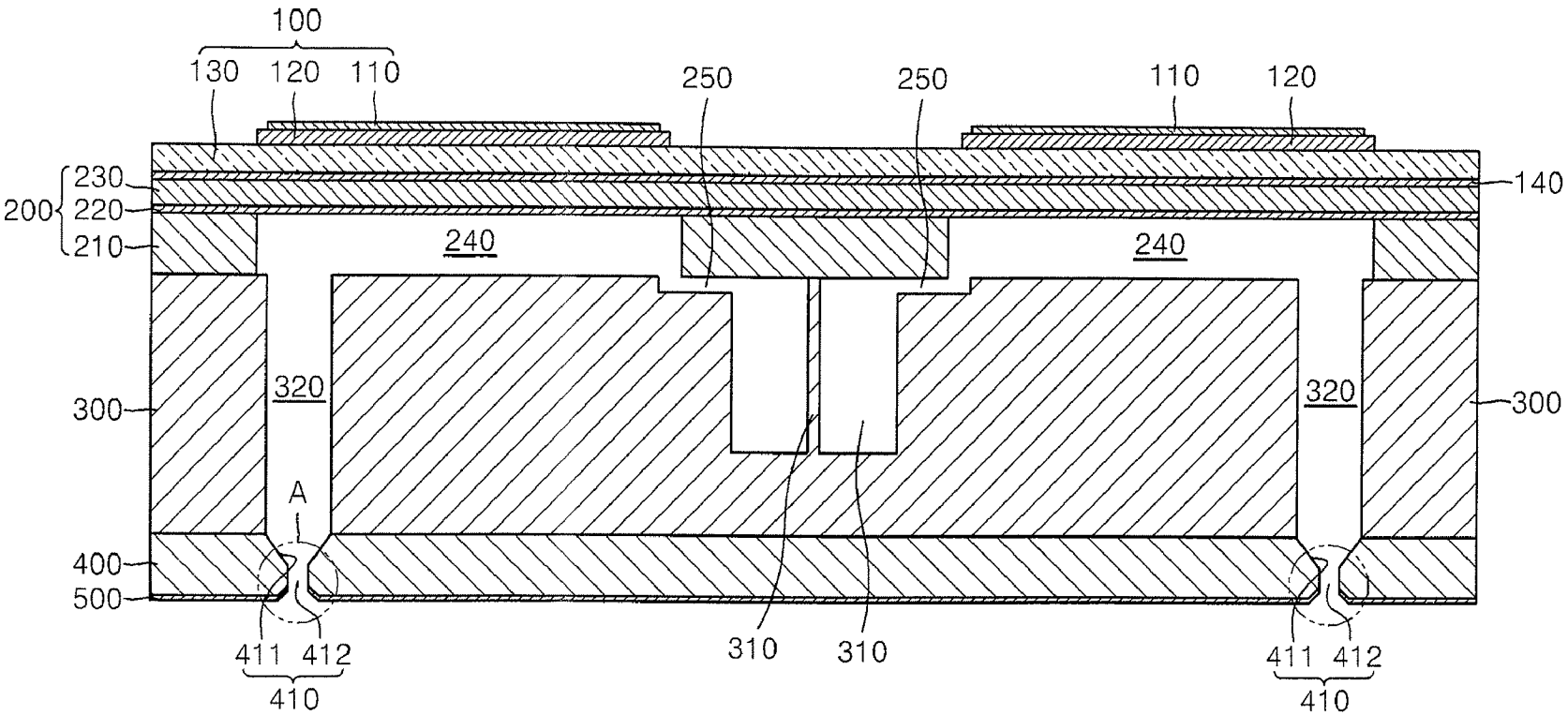
FIG. 3 is a cross-sectional view illustrating a piezoelectric type inkjet printhead including a nozzle, according to an embodiment of the present general inventive concept.
Figure 4:
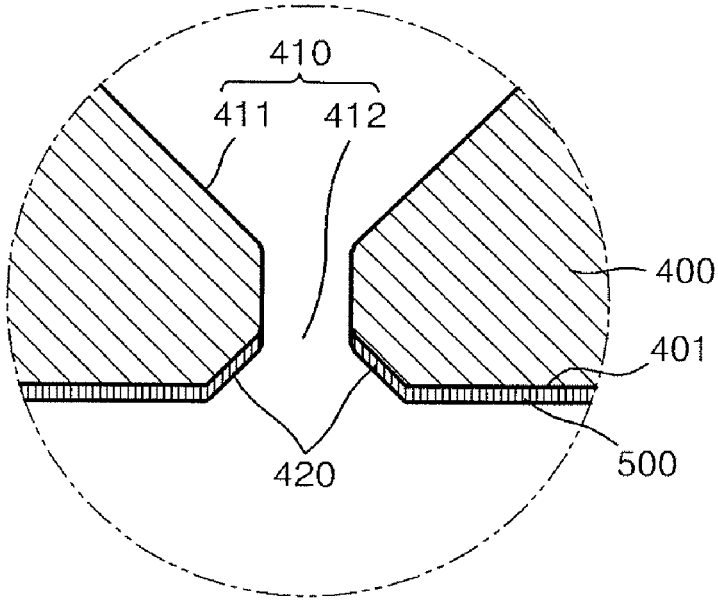
FIG. 4 is an enlarged view of a portion A of the piezoelectric type inkjet printhead of FIG. 3.
Figure 5:
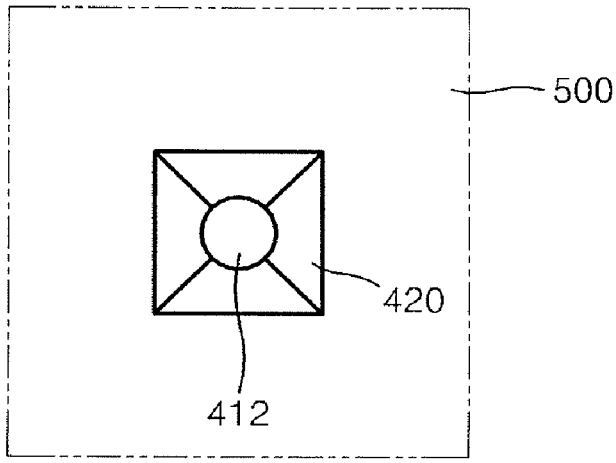
FIG. 5 is a bottom view of the nozzle of FIG. 3.

FIG. 3 is a cross-sectional view illustrating a piezoelectric type inkjet printhead including a nozzle 410, according to an embodiment of the present general inventive concept. FIG. 4 is an enlarged view of a portion A of FIG. 3, and FIG. 5 is a bottom view of the nozzle 410 of FIG. 3.

Referring to FIG. 3, the piezoelectric type inkjet printhead is configured by stacking and attaching upper, intermediate, and lower substrates 200, 300 and 400. The elements constituting an ink flow channel are formed in each of the upper, intermediate, and lower substrates 200, 300 and 400. A piezoelectric actuator 100 that generates driving power for to eject ink is disposed on the upper substrate 200. In particular, since each of the upper, intermediate, and lower substrates 200, 300 and 400 is a single crystal silicon wafer, the elements constituting the ink flow channel can be formed to be very minute and be easily formed in each of the upper, intermediate, and lower substrates 200, 300 and 400 using micromachining technology such as photolithography and etching.

The ink flow channel includes a reservoir 310 in which ink that flows from an ink container (now shown) is stored, a restrictor 250 that provides ink from the reservoir 310 to a pressure chamber 240, the pressure chamber 240 in which ink that is to be ejected is filled, and which varies in pressure in order to eject ink, and a nozzle 410 through which ink is ejected. A damper 320 is formed as an ink path between the pressure chamber 240 and the nozzle 410, and the damper 320 concentrates energy generated by the pressure chamber 240 towards the nozzle 410 due to the piezoelectric actuator 100 and buffs remarkable pressure change. The elements constituting the ink flow channel are separated so as to be respectively disposed in the upper, intermediate, and lower 200, 300 and 400, as described above.

The pressure chamber 240 having a predetermined depth is formed in a lower surface of the upper substrate 200, which is a single crystal silicon wafer that is widely used for manufacturing integrated circuits. In particular, the upper substrate 200 may be a silicon-on-insulator (SOI) wafer having a stack structure including a first silicon substrate 210, an inter-oxide layer 220 formed on the first silicon substrate 210, and a second silicon substrate 230 attached to the inter-oxide layer 220. The first silicon substrate 210 is formed of silicon single crystal, and has a thickness of about several hundreds of μm. The inter-oxide layer 220 is formed by oxidizing a surface of the first silicon substrate 210, and has a thickness in the range of about 1 to 2 μm. The second silicon substrate 230 is formed of silicon single crystal, and has a thickness of about several tens of μm. Since the SOI wafer is used as the upper substrate 200 as described above, the depth of the pressure chamber 240 can be correctly adjusted. Hence, the inter-oxide layer 220 constituting an intermediate layer of the SOI wafer functions as an etch stop layer. Thus, when the thickness of the first silicon substrate 210 is determined, the depth of the pressure chamber 240 is accordingly determined. In addition, the second silicon substrate 230 constituting an upper wall of the pressure chamber 240 is deformed so as to bend due to the piezoelectric actuator 100, and thus, the second silicon substrate 230 functions as a diaphragm that changes the volume of the pressure chamber 240, and the thickness of the diaphragm is determined according to the thickness of the second silicon substrate 230.

The piezoelectric actuator 100 is disposed on the upper substrate 200. A silicon oxide layer 140 functioning as an insulating layer is formed between the upper substrate 200 and the piezoelectric actuator 100. The piezoelectric actuator 100 includes a lower electrode 130 functioning as a common electrode, a piezoelectric film 120 that deforms according to an applied voltage, and an upper electrode 110 functioning as a driving electrode to apply the voltage. The piezoelectric film 120 is formed on the lower electrode 130, and is disposed right above the pressure chamber 240. The piezoelectric film 120 is deformed due to the applied voltage so as to bend the second silicon substrate 230 of the upper substrate 200, which constitutes the upper wall of the pressure chamber 240, that is, the diaphragm. The upper electrode 110 is formed on the piezoelectric film 120, and functions as the driving electrode applying the voltage to the piezoelectric film 120.

The reservoir 310, storing ink that flows in from the ink container, is formed in the intermediate substrate 300 to have a predetermined depth. The restrictor 250 is formed in the intermediate substrate 300 to have a depth that is less than that of the reservoir 310, wherein the restrictor 250 connects the reservoir 310 to one end of the pressure chamber 240. In addition, the damper 320, which is vertically formed through the intermediate substrate 300 so as to be perpendicular to the pressure chamber 240, is formed in a portion of the intermediate substrate 300, which corresponds to other end of the pressure chamber 240. The restrictor 250 prevents ink from flowing back into the reservoir 310 from the pressure chamber 240 when ink is ejected, as well as functions as a path to supply ink from the reservoir 310 to the pressure chamber 240. In order to prevent ink from flowing back into the reservoir 310, the cross section of the restrictor 250 may be much smaller than each of those of the pressure chamber 240 and the damper 320.

The first silicon substrate 210, the intermediate substrate 300, and the lower substrate 400 may be formed in a single monolithic body as a single substrate. The pressure chamber 240 is formed in the first silicon substrate 210.

The nozzle 410 is formed through the lower substrate 400 on a portion of the lower substrate 400, which corresponds to the damper 320., and the nozzle 410 includes an ink ejecting hole 412 formed in a lower portion of the lower substrate 400, and an ink leading unit 411 formed in an upper portion of the lower substrate 400. Ink is ejected through the ink ejecting hole 412. The ink leading unit 411 connects the damper 320 to the ink ejecting hole 412, and pressurizes and leads ink from the damper 320 into the ink ejecting hole 412. The ink ejecting hole 412 is a vertical hole having a predetermined diameter. The ink leading unit 411 has a shape of circular cone of which a cross section gradually decreases from the damper 320 towards the ink ejecting hole 412. That is, the ink leading unit 411 may have a shape of a frustum of a cone. A surface to define the ink leading unit 411 corresponds to a side surface of the frustum of a cone.

Referring to FIGS. 4 and 5, the nozzle 410 is formed in the lower substrate 400 to have a predetermined depth from a bottom surface 401 of the lower substrate 400. An inclination portion 420, which is inclined inwards at a predetermined angle, is formed at the entrance of the ink ejecting hole 412, and the inclination portion 420 connects the ink ejecting hole 412 to the bottom surface 401 of the lower substrate 400. The inclination portion 420 and the bottom surface 401 of the lower substrate 400 are all coated with a hydrophobic layer 500.

As illustrated in FIG. 5, the ink ejecting hole 412 has a circular shape, and the inclination portion 420 has an inside surface to correspond to the circular shape of the ink ejecting hole 412, and an outside surface extended from the inside surface toward an outside of the nozzle 410, i.e., toward the bottom surface 401 the lower substrate 400 to have a rectangular or circular circumference. However, the present general inventive concept is not limited thereto. A surface of the lower substrate 400 defines the inclination portion 420 and may have a side surface of a frustum of a cone to define the inclination portion 420 and to correspond to the reversed shape of the ink leading unit 411 in different dimension, i.e., size or area. The inclination portion 420 has an area corresponding to the inside surface, and another area corresponding to the outside surface, and the another area of the outside surface is larger than the area of the inside surface in a direction perpendicular to an ink flowing direction of the damper 320, the ink leading unit 411, and the ink ejecting hole. The inclination portion 420 may have a first angle with a surface to define the ink ejecting hole 412 and a second angle with the bottom surface 401.

The hydrophobic layer 500 may have a first hydrophobic layer formed on the bottom surface 401, and a second hydrophobic layer formed on the inclination portion 420. An end portion of the second hydrophobic layer of the hydrophobic layer 500 may form a part of the ink ejecting hole 412, as illustrated in FIG. 4.

The hydrophobic layer may include a first portion formed on the bottom surface of the substrate and having a first thickness and a second portion formed on the inclination portion and having a second thickness. The first thickness in a direction perpendicular to the bottom surface may be thicker than the second thickness in a direction perpendicular to the surface of the inclination portion. The first thickness and the second thickness may be a same in the ink ejecting direction.

Accordingly, a wiper (see FIG. 1) may not direct-contact the inclination portion 420 when the wiper wipes ink stained on the bottom surface 401 of the lower substrate 400, the hydrophobic layer 500 coated on the inclination portion 420 barely comes off, and remaining ink can flow along the inclination portion 420. Thus, ink drops can be stably ejected through the ink ejecting hole 412 of the nozzle 410.

Figure 6:
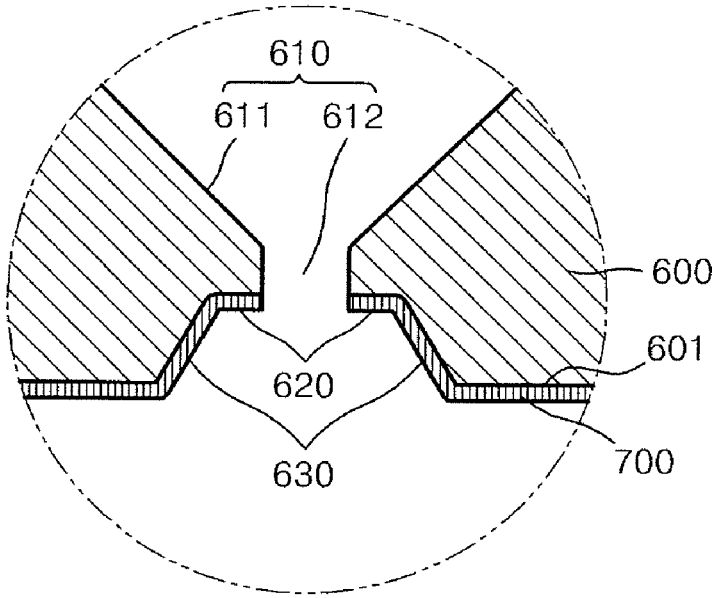
FIG. 6 is an enlarged cross-sectional view illustrating a nozzle, according to an embodiment of the present general inventive concept.
Figure 7:
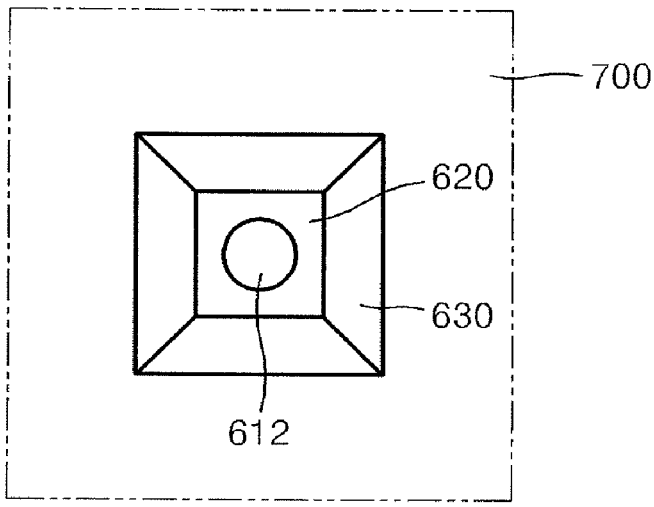
FIG. 7 is a bottom view of the nozzle of FIG. 6.

FIG. 6 is an enlarged view illustrating a nozzle 610, according to an embodiment of the present general inventive concept. FIG. 7 is a bottom view of the nozzle 610 of FIG. 6.

Referring to FIGS. 6 and 7, the nozzle 610 is formed in a lower substrate 600 to have a predetermined depth from a bottom surface 601 of the lower substrate 600. A flat portion 620, which is perpendicular to an ink flowing direction of the ink ejecting hole 612, is formed at the entrance of an ink ejecting hole 612. The flat portion 620 and the bottom surface 601 of the lower substrate 600 are connected by an inclination portion 630 inclined inwards at a predetermined angle. The flat portion 620, the inclination portion 630 and the bottom surface 601 of the lower substrate 600 are all coated with a hydrophobic layer 700. The ink flowing direction may be a center line passing through centers of the damper 320, the ink leading hole 411, and the ink ejecting hole 412.

As illustrated in FIGS. 6 and 7, the ink ejecting hole 612 has a circular shape, and the flat portion has an inside surface extended from the ink ejecting hole 612 and an outside surface connected to an inside surface of the inclination portion 630. An outside surface of the inclination portion 630 has an area larger than the inside surface of the inclination portion 630 and the inside and outside surfaces of the flat portion 620 in a direction perpendicular to the ink flowing direction. The inside surface of the flat portion 620 corresponds to the circular shape of the ink ejecting hole 412, and the outside surface of the flat portion 620 is extended from the inside surface thereof toward the inclination portion 630. The outside surface of the flat portion 620 and the inside and outside surfaces of the inclination portion 630 may be a rectangular shape. However, the present general inventive concept is not limited thereto.

The hydrophobic layer 700 may have a first hydrophobic layer formed on the bottom surface 601, a second hydrophobic layer formed on the inclination portion 430, and a third hydrophobic layer formed on the flat portion 620. An end portion of the third hydrophobic layer of the hydrophobic layer 500 may form a part of the ink ejecting hole 612, as illustrated in FIG. 6

Accordingly, since a wiper (see FIG. 1) does not contact the flat portion 620 and the inclination portion 630 when the wiper wipes ink stained on the bottom surface 601 of the lower substrate 600, the hydrophobic layer 700 coated on the flat portion 620 and the inclination portion 630 barely come off, and remaining ink can flow along the inclination portion 630. Thus, ink drops can be stably ejected through the ink ejecting hole 612.

Figure 8:
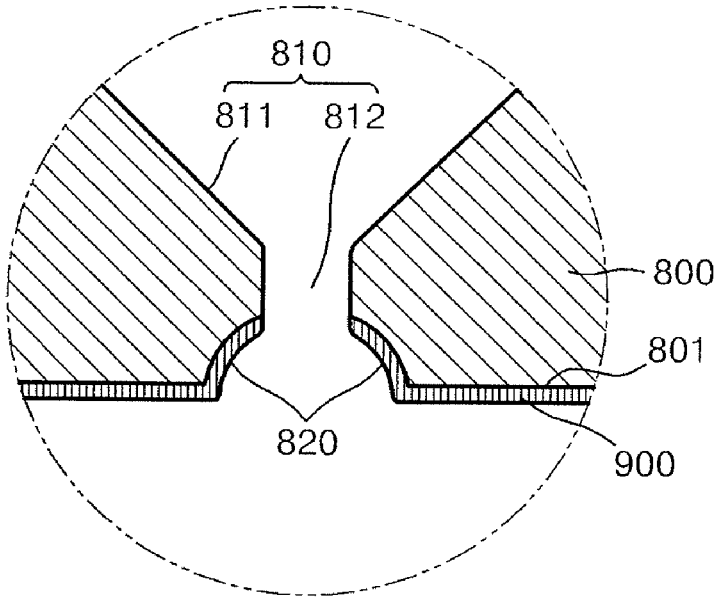
FIG. 8 is an enlarged cross-sectional view illustrating a nozzle, according to an embodiment of the present general inventive concept.
Figure 9:
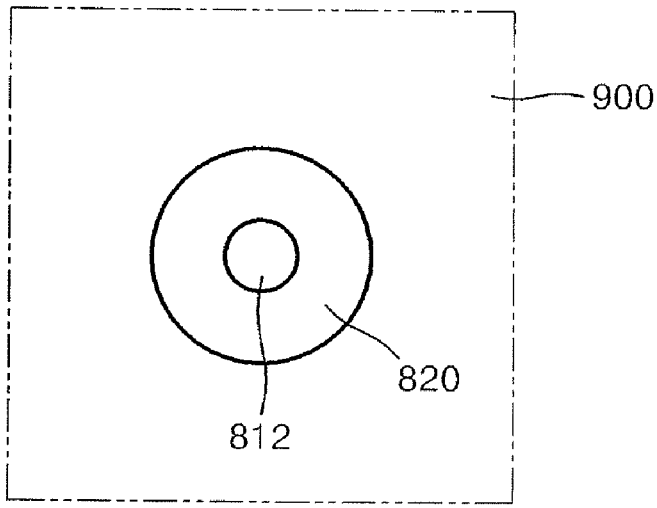
FIG. 9 is a bottom view of the nozzle of FIG. 8.

FIG. 8 is an enlarged view of a nozzle 810, according to an embodiment of the present general inventive concept. FIG. 9 is a bottom view of the nozzle 810 of FIG. 8.

Referring to FIGS. 8 and 9, the nozzle 810 is formed in a lower substrate 800 to have a predetermined depth from a bottom surface 801 of the lower substrate 800. A circular arc portion 820 having a predetermined concave curvature is formed towards the entrance of an ink ejecting hole 812, and the circular arc portion 820 connects the ink ejecting hole 812 to the bottom surface 801 of the lower substrate 800. The circular arc portion 820 and the bottom surface 801 of the lower substrate 800 are all coated with a hydrophobic layer 900.

A surface of the circular arc portion 820 may be a shape of a portion of a side circumferential surface of a sphere in an ink flowing direction of the ink leading unit 811 and the ink ejecting hole 812, and the circular arc portion 820.

The hydrophobic layer 800 may have a first hydrophobic layer formed on the bottom surface 801, and a second hydrophobic layer formed on the inclination portion 820. An end portion of the second hydrophobic layer of the hydrophobic layer 800 may form a part of the ink ejecting hole 812, as illustrated in FIG. 8.

Accordingly, since a wiper (see FIG. 1) does not contact the circular arc portion 820 when the wiper wipes ink stained on the bottom surface 801 of the lower substrate 800, the hydrophobic layer 900 coated on the circular arc portion 820 barely comes off, and remaining ink can flow along the circular arc portion 820. Thus, ink drops can be stably ejected through the ink ejecting hole 812 of the nozzle 810. In addition, a process for forming the circular arc portion 820 is simpler than a process for forming the flat portion 620 illustrated in FIGS. 6 and 7.

An operation of a piezoelectric type inkjet printhead having the above structure will be described by referring to FIG. 3.

Ink that flows from an ink container (not shown) to the inside of the reservoir 310 is supplied to the inside of the pressure chamber 240 through the restrictor 250. When the pressure chamber 240 is filled with ink, a voltage is applied to the piezoelectric film 120 through the upper electrode 110 of the piezoelectric actuator 100, thereby, deforming the piezoelectric film 120, and accordingly, the second silicon substrate 230 of the upper substrate 200, which functions as a diaphragm, is bent downwards. The volume of the pressure chamber 240 is reduced due to the bending due to the deformation of the second silicon substrate 230, and accordingly, the ink filling the pressure chamber 240 passes into the damper 320 and is ejected through the nozzle 410 to the outside due to the rise in pressure.

As described above, the piezoelectric type inkjet according to the present general inventive concept prevents physical damages to a hydrophobic layer that is formed around a nozzle in order to maintain durability and stability of the piezoelectric type inkjet. Thus, reliability can be maintained with respect to the ejecting performance of ink.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A piezoelectric type inkjet printhead comprising:

an upper substrate including a pressure chamber to be filled with ink, a reservoir to store ink flowing in from an ink container, a restrictor to connect the reservoir to one end of the pressure chamber:

an intermediate substrate comprising a damper formed on a portion of the intermediate substrate to correspond to other end of the pressure chamber;

a lower substrate comprising a nozzle to eject ink to correspond to the damper;

a hydrophobic layer formed on a bottom of the lower substrate; and a piezoelectric actuator formed on the upper substrate to supply a driving power to the pressure chamber to eject ink through the nozzle, wherein the nozzle is formed in the lower substrate at a predetermined depth from the bottom surface of the lower substrate, wherein the nozzle comprises:

an ink leading unit connected to the damper and leading ink;

an ink ejecting hole connected to the ink leading unit through which ink is ejected; and an inclination portion formed inclined inwards at a predetermined angle at an entrance of the ink ejecting hole and connected to the bottom surface of the lower substrate.

2. A piezoelectric type inkjet printhead comprising:

an upper substrate including a pressure chamber to be filled with ink, a reservoir to store ink flowing in from an ink container, a restrictor to connect the reservoir to one end of the pressure chamber:

an intermediate substrate comprising a damper formed on a portion of the intermediate substrate to correspond to other end of the pressure chamber;

a lower substrate comprising a nozzle to eject ink to correspond to the damper;

a hydrophobic layer formed on a bottom of the lower substrate; and a piezoelectric actuator formed on the upper substrate to supply a driving power to the pressure chamber to eject ink through the nozzle, wherein the nozzle is formed in the lower substrate at a predetermined depth from the bottom surface of the lower substrate, wherein the nozzle comprises:

an ink leading unit connected to the damper to lead ink; and an ink ejecting hole connected to the ink leading unit to eject ink, wherein a flat portion is formed at an entrance of the ink ejecting hole, an inclination portion is inclined inwards at a predetermined angle to connect the flat portion to the bottom surface of the lower substrate.

3. A piezoelectric type inkjet printhead comprising:

an upper substrate including a pressure chamber to be filled with ink, a reservoir to store ink flowing in from an ink container, a restrictor to connect the reservoir to one end of the pressure chamber:

an intermediate substrate comprising a damper formed on a portion of the intermediate substrate to correspond to other end of the pressure chamber;

a lower substrate comprising a nozzle to elect ink to correspond to the damper;

a hydrophobic layer formed on a bottom of the lower substrate; and a piezoelectric actuator formed on the upper substrate to supply a driving power to the pressure chamber to eject ink through the nozzle, wherein the nozzle is formed in the lower substrate at a predetermined depth from the bottom surface of the lower substrate, wherein the nozzle comprises:

an ink leading unit connected to the damper and leading ink; and an ink ejecting hole connected to the ink leading unit to eject ink, wherein a circular arc portion having a predetermined concave curvature is formed towards an entrance of the ink ejecting hole and connected to a bottom surface of the lower substrate.

4. An inkjet head usable with a piezoelectric type inkjet printhead, comprising:

a substrate having one or more surfaces to define a pressure chamber to be filled with ink, a damper to receive the ink from the pressure chamber, and a nozzle having a center axis as an ink ejecting direction to receive the ink from the damper and to eject the ink to an outside of a bottom surface of the substrate in the ink ejecting direction;

an inclination portion having a surface formed between the surface of the nozzle and the bottom surface of the substrate and inclined with respect to the ink ejecting direction; and a hydrophobic layer formed on the bottom surface of the substrate and the inclination portion.

5. The piezoelectric type inkjet printhead of claim 4, wherein the nozzle is spaced-apart from the bottom surface of the substrate by a distance, and the inclination portion has a length corresponding to the distance in the ink ejecting direction.

6. The piezoelectric type inkjet printhead of claim 4, wherein the nozzle has an nozzle area in a direction perpendicular to the ink ejecting direction, and the inclination portion has an area larger than the nozzle area.

7. The piezoelectric type inkjet printhead of claim 4, wherein the hydrophobic layer comprises an end portion formed on the inclination portion as a part of the surface of the nozzle to eject the ink.

8. The piezoelectric type inkjet printhead of claim 4, wherein the hydrophobic layer comprises an end portion formed on the inclination portion and being parallel to the surface of the nozzle.

9. The piezoelectric type inkjet printhead of claim 4, wherein the hydrophobic layer comprises a first portion formed on the bottom surface of the substrate and having a first thickness and a second portion formed on the inclination portion and having a second thickness.

10. The piezoelectric type inkjet printhead of claim 4, wherein the first thickness in a direction perpendicular to the bottom surface is thicker than the second thickness in a direction perpendicular to the surface of the inclination portion.

11. The piezoelectric type inkjet printhead of claim 4, wherein the first thickness and the second thickness are same in the ink ejecting direction.

12. The piezoelectric type inkjet printhead of claim 4, wherein:

the nozzle comprises an ink leading unit to receive the ink from the damper, and an ink ejecting hole to eject the received ink;

the ink leading unit has a cross-sectional area variable according to a distance from the bottom surface of the substrate;

the ink ejecting hole has a cross-sectional area constant along the ink ejecting direction; and the inclination portion has a cross-sectional area variable according to a distance from the bottom surface of the substrate.

13. The piezoelectric type inkjet printhead of claim 4, wherein:

the surface of the nozzle comprises a first surface to define an ink leading unit to receive the ink from the damper, and a second surface to define an ink ejecting hole to eject the received ink; and the inclination portion comprises an inside circumference corresponding to the second surface of the ink ejecting hole and an outside circumference corresponding to the bottom surface of the substrate.

14. The piezoelectric type inkjet printhead of claim 13, wherein the inside circumference has a first shape, and the outside circumference has a second shape different from the first shape.

15. The piezoelectric type inkjet printhead of claim 13, wherein the inside circumference has a circular shape, and the outside circumference has a non-circular shape.

16. The piezoelectric type inkjet printhead of claim 4, wherein the inclination portion comprises:

an inside circumference corresponding to the surface of the nozzle and having a first dimension; and an outside circumference corresponding to the bottom surface of the substrate and having a second dimension.

17. The piezoelectric type inkjet printhead of claim 16, wherein the surface of the inclination portion is connected between the inside circumference and the outside circumference.

18. The piezoelectric type inkjet printhead of claim 4, wherein the surface of the inclination portion comprises one of a flat surface, a curved surface, and an inclined surface.

19. The piezoelectric type inkjet printhead of claim 4, wherein the surface of the inclination portion comprises a combination of a flat surface, a curved surface, and an inclined surface.

20. The piezoelectric type inkjet printhead of claim 4, wherein the surface of the inclination portion is different from the surface of the nozzle in the ink ejecting direction.

21. An inkjet head usable with a piezoelectric type inkjet printhead, comprising:

a substrate having surfaces to define a pressure chamber to be filled with ink, a damper to receive the ink from the pressure chamber, and a nozzle disposed along an ink ejecting direction to receive the ink from the damper and eject the ink to an outside of a bottom surface of the substrate;

an inclination portion disposed between the nozzle and the bottom surface of the substrate to have an angle with the ink ejecting direction; and a hydrophobic layer formed on the bottom surface of the substrate and the inclination portion.

22. An inkjet head usable with a piezoelectric type inkjet printhead, comprising:

a substrate having surfaces to define a pressure chamber to be filled with ink, a damper to receive the ink from the pressure chamber, and a nozzle disposed along an ink ejecting direction to receive the ink from the damper and eject the ink to an outside of a bottom surface of the substrate;

an inclination portion connected between the nozzle and the bottom surface of the substrate and having an ink ejecting area increasing in the ink ejecting direction; and a hydrophobic layer formed on the bottom surface of the substrate and the inclination portion.

23. An inkjet head usable with a piezoelectric type inkjet printhead, comprising:

a substrate having surfaces to define a pressure chamber to be filled with ink, a damper to receive the ink from the pressure chamber, and a nozzle having a first cross-sectional area constant in an ink ejecting direction to receive the ink from the damper and to eject the ink to an outside of a bottom surface of the substrate in the ink ejecting direction;

an inclination portion formed between the nozzle and the bottom surface of the substrate and having a second cross-sectional area varying according to a distance from the bottom surface of the substrate; and a hydrophobic layer formed on the bottom surface of the substrate and the inclination portion.

24. An inkjet head usable with a piezoelectric type inkjet printhead, comprising:

a substrate having surfaces to define a pressure chamber to be filled with ink, a damper to receive the ink from the pressure chamber, and a nozzle having a first shape to receive the ink from the damper and eject the ink to an outside of a bottom surface of the substrate;

an inclination portion having a surface formed between the nozzle and the bottom surface of the substrate and having a second shape different from the first shape of the nozzle; and a hydrophobic layer formed on the bottom surface of the substrate and the inclination portion.

* * * * *

UNITED STATES PATENT AND TRADEMARK OFFICE

CERTIFICATE OF CORRECTION

PATENT NO. : 7,909,438 B2
APPLICATION NO. : 11/775424
DATED : March 22, 2011
INVENTOR(S) : Tae-kyung Lee et al.

It is certified that error appears in the above-identified patent and that said Letters Patent is hereby corrected as shown below:

Title Page; item (73);
Assignee: "Samsung Electronics Co., Ltd" should be "Samsung Electro-Mechanics Co., Ltd."

Signed and Sealed this
Twenty-eighth Day of June, 2011

David J. Kappos

David J. Kappos
*Director of the United States Patent and Trademark Office*